US009779612B2

(12) United States Patent
Darval et al.

(10) Patent No.: US 9,779,612 B2
(45) Date of Patent: Oct. 3, 2017

(54) WIRELESS ITEM LOSS PREVENTION SYSTEM

(71) Applicant: TETHER TECHNOLOGIES, INC., Seattle, WA (US)

(72) Inventors: Matthew D. Darval, Yakima, WA (US); Keith W. Kirkwood, Bainbridge Island, WA (US); John D. Suryan, Bellevue, WA (US); Scott C. Thielman, Seattle, WA (US); George M. Niederauer, Seattle, WA (US); Keith M. Brown, Seattle, WA (US); Edgar R. Neely, III, Vashon, WA (US)

(73) Assignee: Tether Technologies, Inc., Seattle, WA (US)

( * ) Notice: Subject to any disclaimer, the term of this patent is extended or adjusted under 35 U.S.C. 154(b) by 0 days.

(21) Appl. No.: 14/487,076

(22) Filed: Sep. 15, 2014

(65) Prior Publication Data

US 2016/0078746 A1 Mar. 17, 2016

(51) Int. Cl.
*G08B 21/24* (2006.01)
*G08B 13/24* (2006.01)

(52) U.S. Cl.
CPC ..... *G08B 21/24* (2013.01); *G08B 13/2408* (2013.01); *G08B 13/248* (2013.01)

(58) Field of Classification Search
CPC .. G08B 13/248; G08B 13/2402; G08B 21/24; G08B 1/08; G08B 13/2408; G08B 13/2465; G08B 13/2482; G08B 13/2485
See application file for complete search history.

(56) References Cited

U.S. PATENT DOCUMENTS

| | | | | |
|---|---|---|---|---|
| 8,471,706 | B2 * | 6/2013 | Schuster | G06Q 10/06 340/572.1 |
| 8,810,392 | B1 * | 8/2014 | Teller | G08B 21/24 235/385 |
| 8,836,507 | B2 * | 9/2014 | Thielman | G08B 21/24 340/539.1 |
| 2006/0132301 | A1 * | 6/2006 | Stilp | G05B 9/03 340/539.22 |
| 2014/0035754 | A1 * | 2/2014 | Thielman | G08B 21/182 340/686.6 |
| 2014/0089243 | A1 * | 3/2014 | Oppenheimer | G06F 21/50 706/46 |
| 2014/0145847 | A1 * | 5/2014 | Jenkins | G08B 13/1427 340/572.1 |
| 2015/0170496 | A1 * | 6/2015 | King | G08B 21/24 340/686.6 |

* cited by examiner

*Primary Examiner* — Van Trieu
(74) *Attorney, Agent, or Firm* — Fogg & Powers LLC

(57) ABSTRACT

An item loss prevention system for protecting from the loss of items from a user, and more specifically to an electronic device utilizing a wireless connection between a remote unit attached to an item, such as a set of one or more keys, and a host or belt unit attached to the user, to prevent the loss of the item. The system includes magnetic sensors between the item and the belt, which are Hall type magnetic sensors, coupled with an accelerometer. With the additional input from the accelerometer, an alarm activates when the item, such as a key, is separated at a distance from the belt or host unit. Additionally, the key unit can attach to an unpairing station to re-set the remote unite for re-pairing to another host unit.

15 Claims, 9 Drawing Sheets

WIRELESS ITEM LOSS PREVENTION SYSTEM

CROSS-REFERENCE TO RELATED APPLICATIONS

This Non-Provisional Utility Patent Application is subject to an obligation of assignment to the same entity as Non-Provisional Utility patent application Ser. No. 13/568,073, filed Aug. 6, 2012, and now pending, of which its patent application and prosecution history is incorporated herein by reference in its entirety, to provide continuity of disclosure.

TECHNICAL FIELD

This invention relates generally to the field of electronic item loss protection, and more specifically to a device utilizing a wireless connection between an item and a belt or docking station, to prevent loss of the item. The system includes magnetic sensors between the item and the belt, coupled with an accelerometer. With the additional input from the accelerometer, an alarm activates when the item, such as a key, is separated at a distance from the belt or host unit.

BACKGROUND OF THE INVENTION

All secure areas of conventional building structures have the need for keys, typically carried by persons for purposes of accessing these secure areas. The key may be a standard metallic 'hard' key, or newer electronic and 'swipe' types of keys. There is an inherent risk when keys are carried by persons, in that the keys may be lost or misplaced and in many cases unrecoverable and irreplaceable. Additionally, a lost or misplaced key is a real and potentially debilitating security threat to the building and its secure contents. Typically, a significant investment is required to re-pin or re-key a door or access point, and the loss of a master key may require the re-keying of an entire facility or building.

Responding to this significant risk, many organizations attempt to mitigate the potential loss by designing and implementing 'key control procedures.' These procedures limit personnel's access to keys or at least to master keys, and may require an authorized individual to sign keys in and out. In many cases, the individual must relinquish personal identification to establish positive custody of the key. Often the key holder's personal identification card is held until the keys are safely returned and accounted for.

Other items may need to be kept secure in much the same manner as conventional keys. The item may be any needed element of a security system, such as an identification card, a data chip or hard-drive, or a valuable item or container. Again, there is an inherent risk when any item is carried by persons, in that the item may be lost or misplaced and in many cases unrecoverable and irreplaceable. Additionally, a lost or misplaced item is potentially non replaceable, even with adequate insurance, which may be too costly to acquire in coverage of potential loss.

Co-pending U.S. patent application Ser. No. 13/568,073, also assigned to Tether Technologies, Inc. of Seattle, Wash., discloses a Wireless Item Loss Prevention System, with many of the basic features of the present invention. However, there is still a need for improvement in the institutional control of items including keys, which involves a more simple and efficient procedure or system for the issuance and tracking of the items. There is a need for improvement in the reliable handling of keys and other items, as required for high security facilities and in the transfers of valuable or high security items, such as banks, hospitals, government offices and other secure buildings. A preemptive item loss system must strive to eliminate the lost time, security breaches and costly repercussions due to lost keys.

The present invention provides for an improved control of items, such as keys, which can efficiently track and prevent the loss or misplacement of keys. This improved control is well suited for use in typical institutional facilities and other secure buildings or structures. The present invention will be better understood by reference to the following detailed description taken in conjunction with the accompanying drawings.

BRIEF DESCRIPTION OF DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF SPECIFIC EMBODIMENTS

Detailed descriptions of the preferred embodiment are provided herein. It is to be understood that the present invention may be embodied in various forms. Therefore, specific details disclosed herein are not to be interpreted as limiting, but rather as a basis for the claims and as a representative basis for teaching one skilled in the technical field, to employ the present invention in virtually any appropriately applied system, structure or manner.

For the purposes of explanation, specific embodiments are set forth to provide a thorough understanding of the present invention. However, it will be understood by one skilled in the appropriate technical field upon the reading the disclosure that the invention may be practiced without these additional details. Moreover, well-known elements, process steps and the like, are not set forth in overt detail, in order to avoid obscuring the disclosed system. These excess details may include, but are not limited to mechanical components and electronic circuitry components, with their related connections.

Initially envisioned as a proactive way to prevent items, such as keys, from being misplaced or lost, the basic functioning of the item loss prevention system of the present invention was initially disclosed in co-pending U.S. patent application Ser. No. 13/568,073, which discloses an electronic wireless 'tether,' to keep a remote item, such a key ring within a separation distance or radius from a user. Alarms on both the remote item unit and the belt attachable unit are initiated, if the remote item moves beyond the specified radius of separation, thus preventing the loss of the remote item. This system is preemptive, in that it is able to eliminate lost time, security breaches and costly repercussions due to a loss of important items.

The present disclosure details additional inventive features and functions that improve upon the co-pending prior disclosure, as described herein. Generally, FIGS. 1 through 9 show aspects of an Improved Item Loss Prevention System 10, in accordance with preferred embodiments of the present invention.

Figure 1:
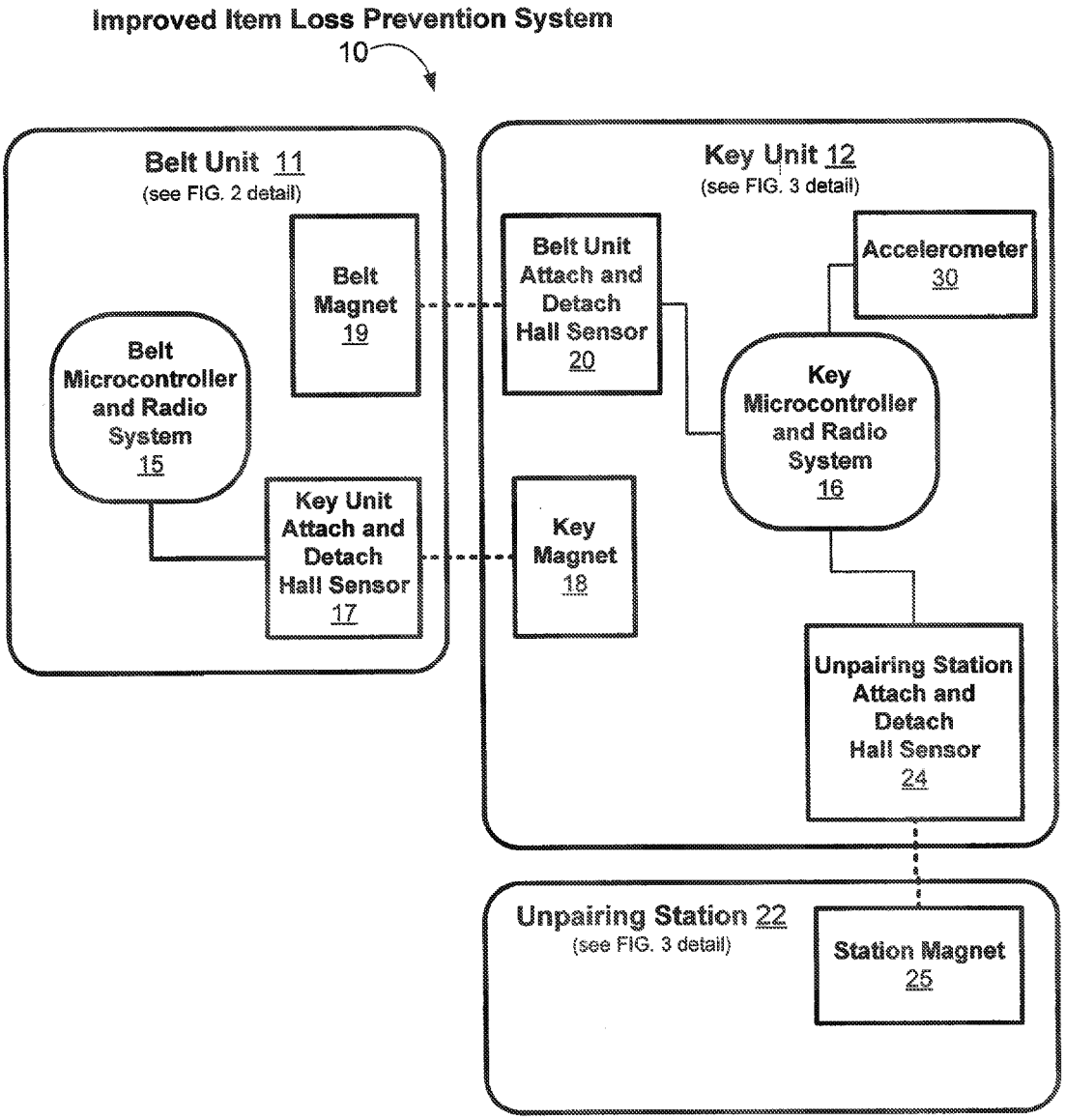
FIG. 1 is an overall component schematic diagram of an improved wireless item loss prevention system, generally according to an embodiment of the invention.
Figure 2:
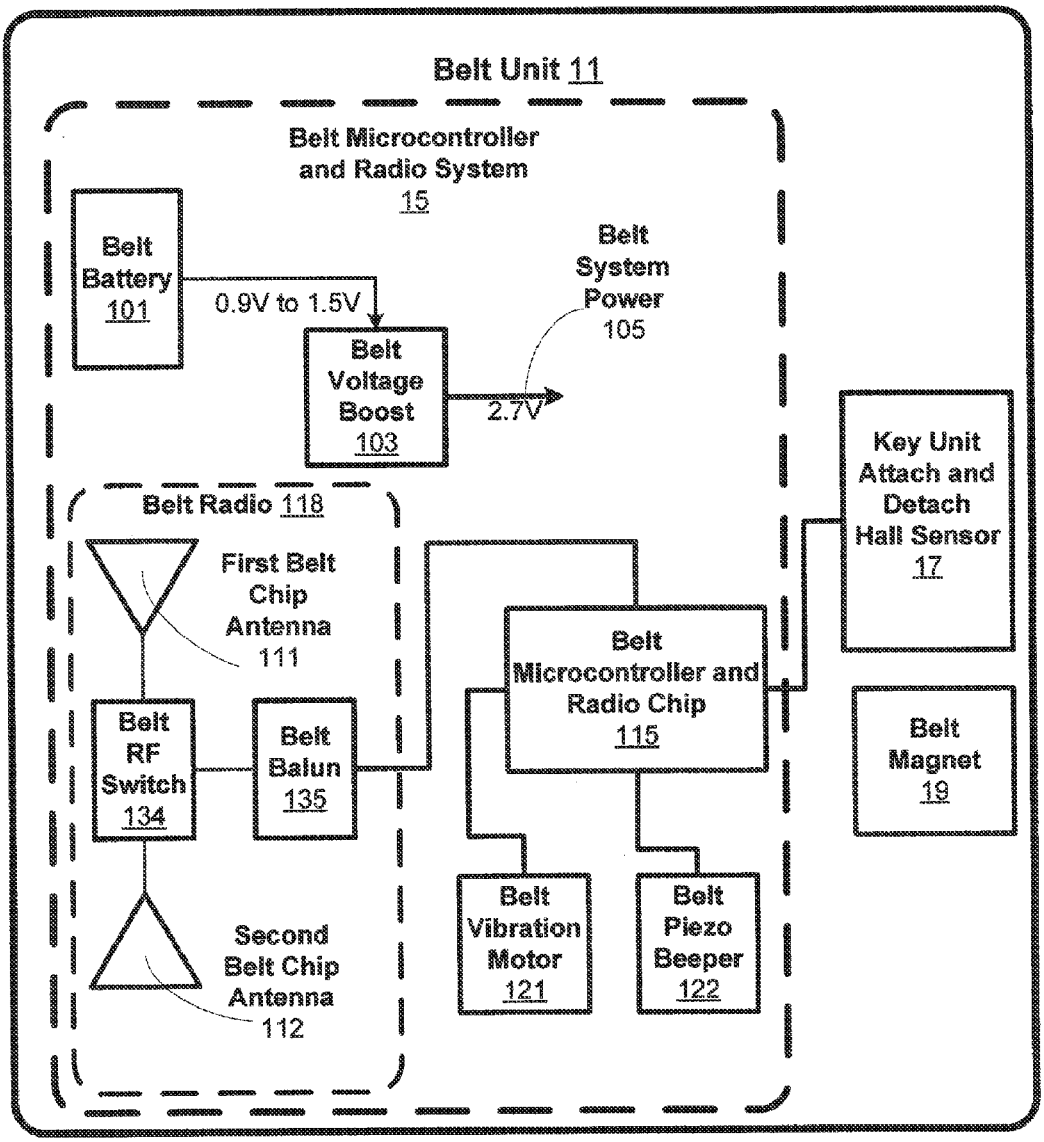
FIG. 2 is a first component schematic diagram of a portion of an improved wireless item loss prevention system, detailing features according to an embodiment of the invention.
Figure 3:
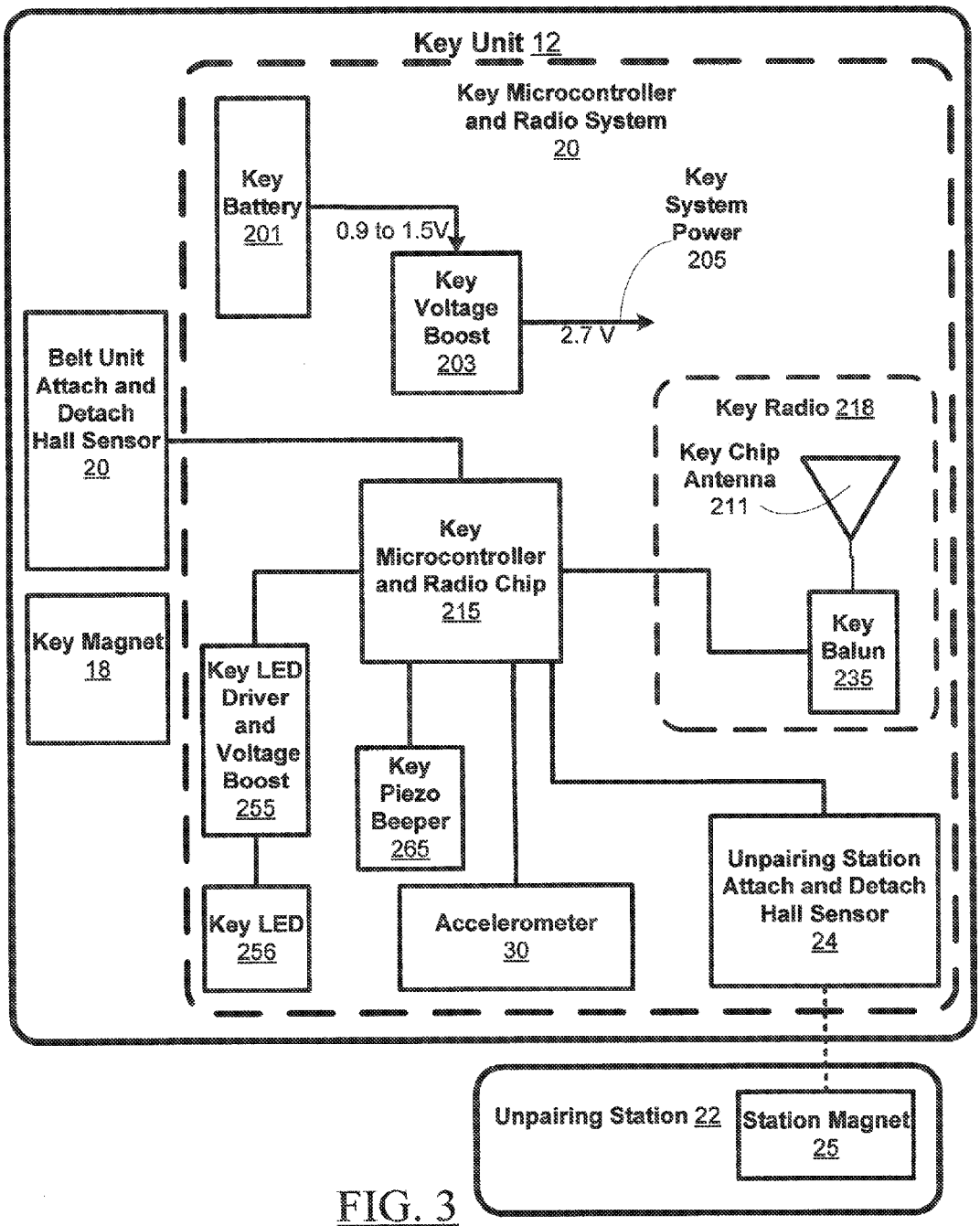
FIG. 3 is a second component schematic diagram of a portion of an improved item loss prevention system, detailing features according to an embodiment of the invention.

Specifically, FIGS. 1 through 3 show a schematic view of elemental components of a preferred embodiment of the Improved Item Loss Prevention System 10, with FIG. 1 showing an overall component schematic diagram, and FIGS. 2 and 3 detailing portions of FIG. 1. For the purposes of the present disclosure, the Improved Item Loss Prevention System may be referred to herein alternatively as an "Improved Key Loss Prevention System," or "Improved Item Loss Prevention System," especially when the "item" referred to is a "key," or any similar item or element. More simply, the Improved Item Loss Prevention System may be referred to herein as the "Loss Prevention System." Again, the terms "item" or "remote item" are interchangeable with and understood to be equivalent to the term "key" in the present disclosure, claims and drawings.

Figure 7:
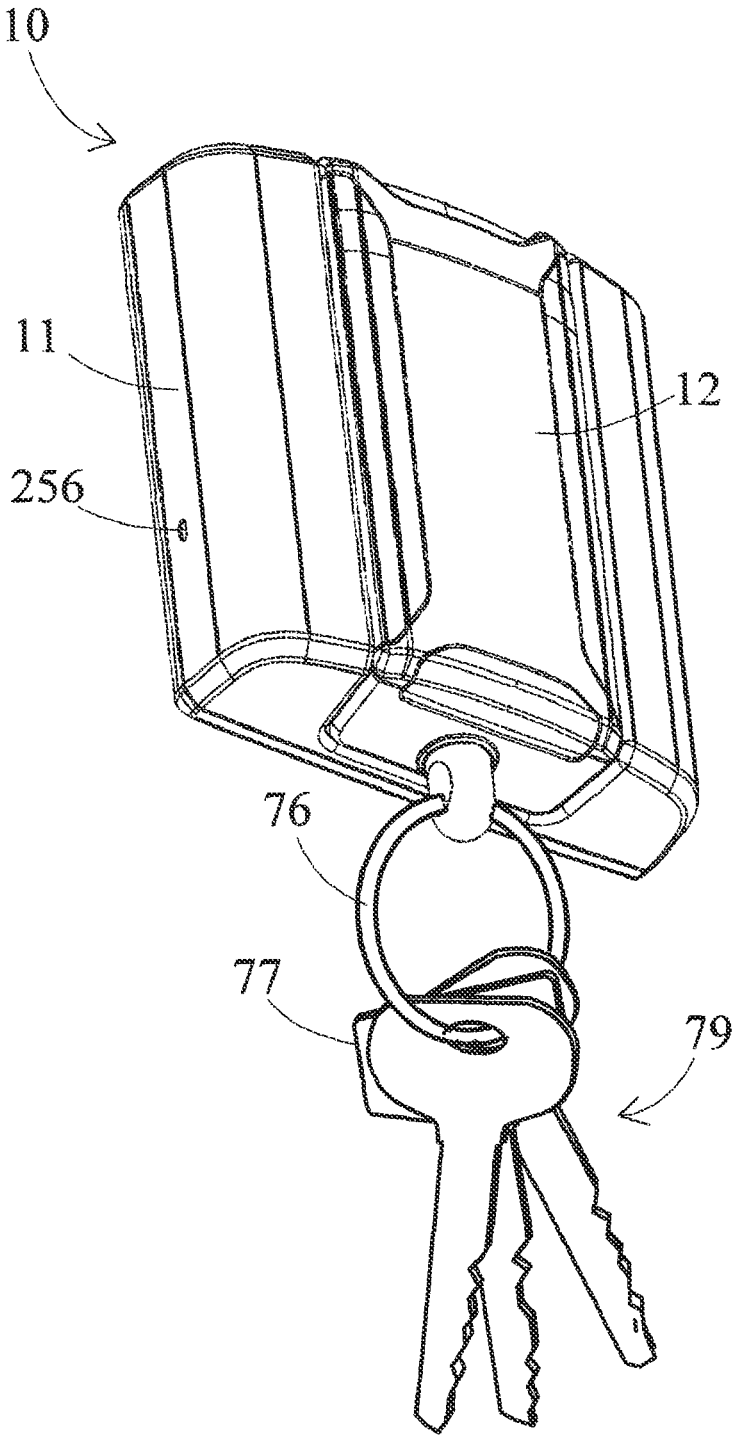
FIG. 7 is a perspective view of the improved item loss prevention system, according to an embodiment of the invention.
Figure 8:
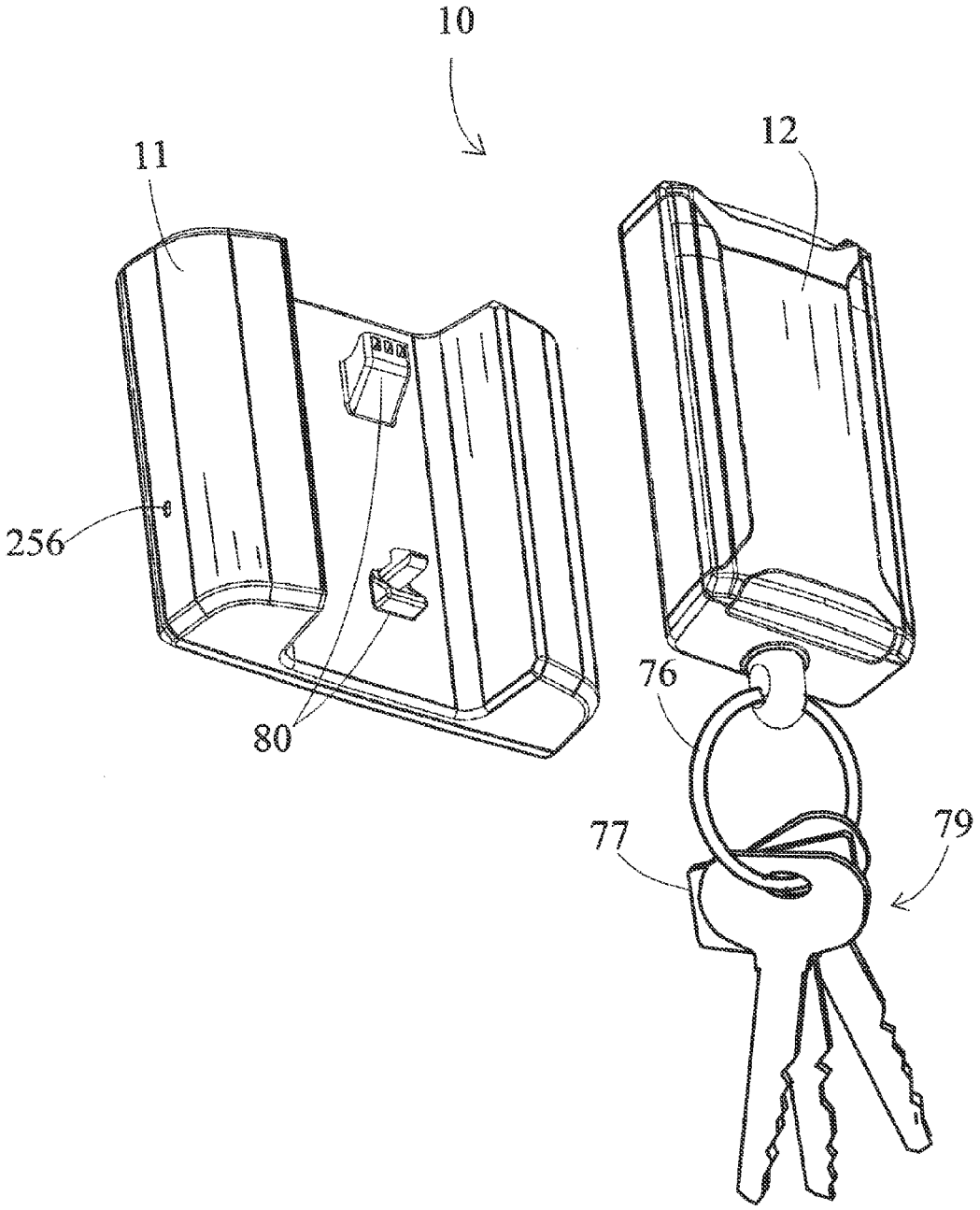
FIG. 8 is a perspective view of the improved item loss prevention system, according to an embodiment of the invention.
Figure 9:
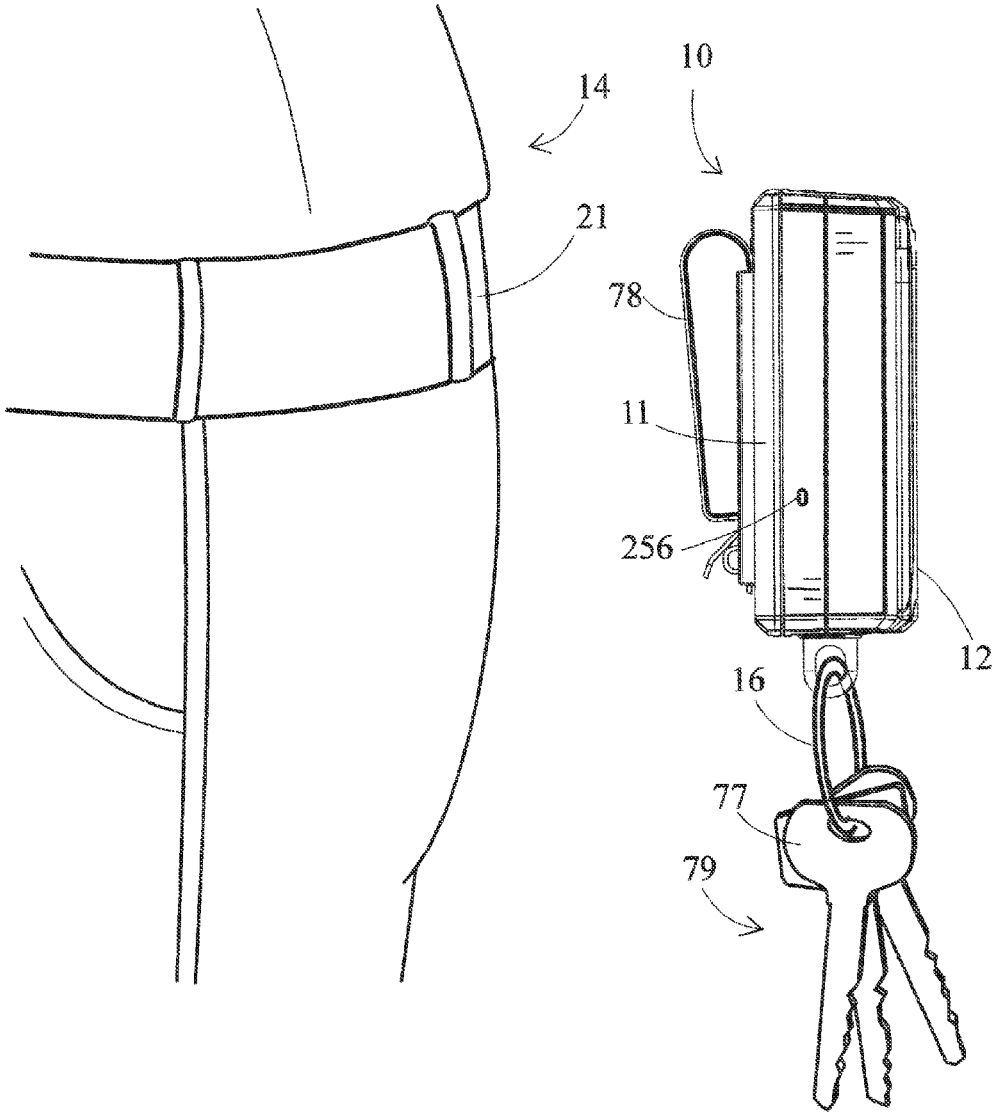
FIG. 9 is a side view of the improved item loss prevention system with a user, according to an embodiment of the invention.

In a preferred embodiment of the Improved Item Loss Prevention System 10, FIGS. 7 through 9 show a Belt Unit 11 physically couple-able with a Key Unit 12. In FIG. 1, the overall component schematic diagram shows that the Belt Unit is operationally couple-able with a Key Unit 12, with the operation of the Belt Unit is directed and controlled by a Belt Microcontroller and Radio System 15, which receives important input relating to the attachment of the Belt Unit to Key Units, from a Key Unit Attach and Detach Hall Sensor 17. The Belt Unit operates in concert with the Key Unit, and the Key Unit may be referred to as a "Remote Unit," and the Belt Unit may be referred to as a "Host Unit." Similar to the Belt Unit, the operation of the Key Unit is directed and controlled by a Key Microcontroller and Radio System 16, which receives important input relating to the attachment of the Key Unit to Belt Units by a Belt Unit Attach and Detach Hall Sensor 20, and can also receive important input relating to the attachment of the Key Unit or the Unpairing Station 22 by an Unpairing Station Attach and Detach Hall Sensor 24.

When the Belt Unit 11 couples in attachment to with the Key Unit 12, the Key Unit Attach and Detach Hall Sensor 17 of the Belt Unit interfaces with a Key Magnet 18, which is a component of the Key Unit. The Belt Unit also includes a Belt Magnet 19 that interfaces with the Belt Unit Attach and Detach Hall Sensor 20 on the Key Unit, when the Belt Unit couples to the Key Unit. As shown schematically in FIG. 1 as an option, the Key Unit is also couple-able with an Unpairing Station 22, instead of the Belt Unit. For this alternative coupling and attachment of the Key Unit couples to the Unpairing Station, the Key Unit includes an Unpairing Station Attach and Detach Hall Sensor 24, which interfaces with a Station Magnet 25 on the Unpairing Station.

The Unpairing Station 22 is preferably a stationary 'parking and reset dock' for the Key Unit 12, and may be housed in a lockable cabinet or enclosure. The Unpairing Station includes the Station Magnet 25, which like the Key Magnet 18 and the Belt Magnet 19 are each able to interface with and trigger an attachment or detachment output signal from coupled Hall-type sensors. The Unpairing Station provides a power conserving feature to the Improved Item Loss Prevention System 10, in that the Key Unit can enter a power saving deep sleep mode, while unpaired at the Unpairing Station, which can also serve to charge the Key Battery 201 in the Key Unit.

An important feature of the Item Loss Prevention System 10 is the use of electromagnetic sensors on both the Belt Unit 11 and Key Unit 12, and to monitor the presence of the Key Unit in the cradling Belt Unit or the absence of the Key Unit from a direct contact with the Belt Unit. Specifically, the Key Unit Attach and Detach Hall Sensor 17 is employed in the Belt Unit, and the Attach and Detach Hall Sensor 20 is employed in the Key Unit. Both sensors are most preferably 'Hall-type' integrated circuits, which are essentially magnetic switches that can operate 'omnipolar,' with both S-poles and N-poles, to detect the close proximity of magnets upon attachment, such as the Key Magnet 18, the Belt Magnet 19, and the Station Magnet 25. The use of the magnetic switches is critical to the efficiency and reliability of the Improved Item Loss Prevention System, especially with additional monitoring from an Accelerometer 30, as shown schematically in FIG. 3, in that a significant reduction in false alarms and improved operation of the Loss Prevention System.

Specifically, with the use of the Hall-type sensors, each paired with coupling magnets in the Item Loss Prevention System 10, the Key Magnet 18 of the Belt Unit 11 is couple-able to the Key Unit Attach and Detach Hall Sensor 17 of the Belt Unit 11. Likewise, the Belt Magnet 19 of the Key Unit 12 is couple-able to the Belt Unit Attach and Detach Hall Sensor 20 of the Key Unit. Additionally, the Improved Loss Prevention System includes the use of an additional Hall-type sensor paired with a coupling magnet, in the Unpairing Station 22, which includes a Station Magnet 25 couple-able to the Unpairing Station Attach and Detach Hall Sensor 24 of the Key Unit 12. As shown in the operational overview schematic of FIG. 4, a Key Unit Initialize 40 of the Improved Item Loss Prevention System 10 preferably results from a Key Unit Power On 45 from a User 14 of the Item Loss Prevention System. As shown in FIG. 1, the Item Loss Prevention System 10 is preferably embodied by a 'three-unit' or 'three-component' system, employing a Belt Unit 11, the Key Unit 12 and the Unpairing Station 22. The Belt Unit receives the Key Unit 12, which again in the alternative may be referred to as a "Remote Unit," in that items in alternative to actual keys may be included with the Key Unit. An item 77 is attached to the Key Unit, and as shown in FIG. 7. Again, the item preferably includes a Key Ring 76 with a Set of One or More Keys 79, but could be any item that the User desires to track and control with the Item Loss Prevention System. The Belt Unit preferably includes a Belt Clip 78 that is receivable onto the User 14, and preferably attachable onto the Belt 21 of the User, as shown in FIG. 9, or attachable to a similar functioning strap, holster or clothing article. The Belt Unit may also be referred to herein and in the attached claims as a "Host Unit," in that it is not required to be attached to a belt, or include the belt clip, but only that it is attachable to or receivable onto the Belt 21 of, or otherwise wearable by the User.

Figure 4:
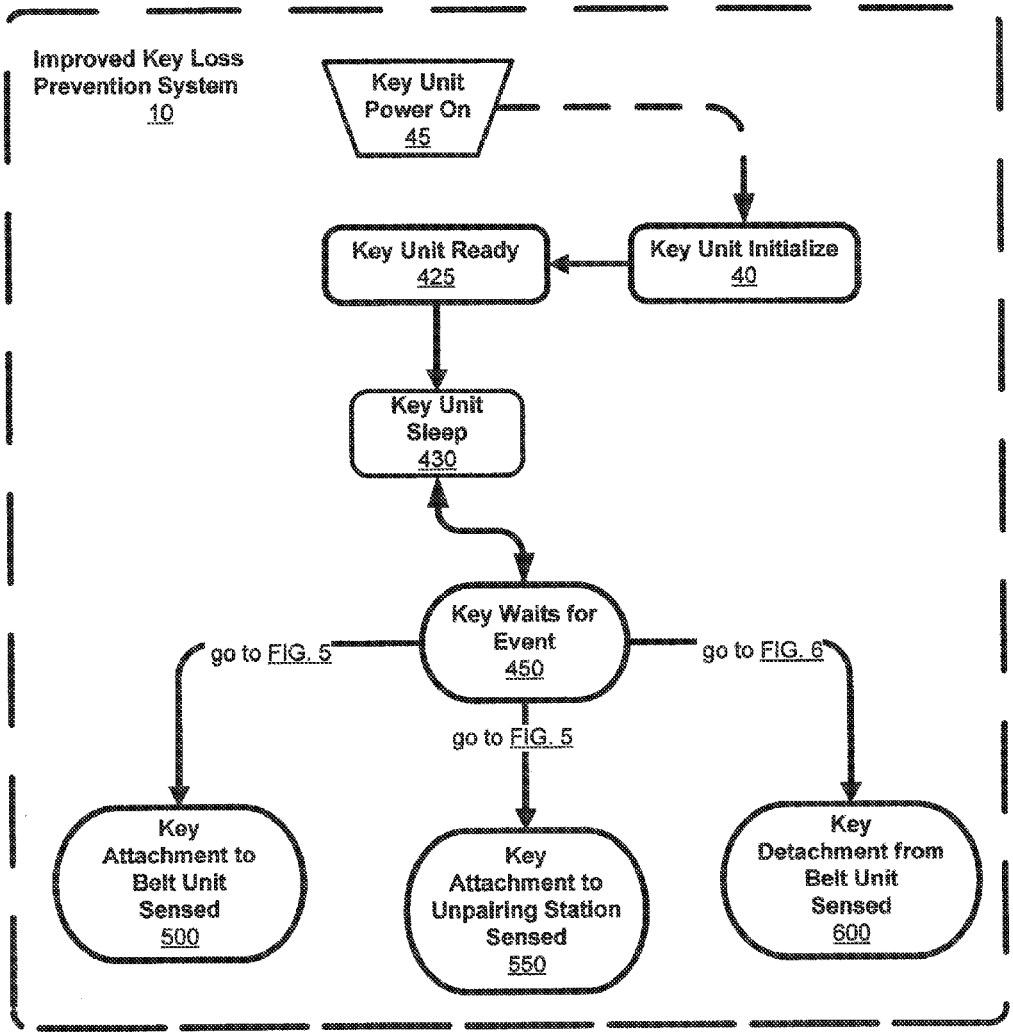
FIG. 4 is an operational schematic diagram of an improved item loss prevention system, generally according to an embodiment of the invention.

The Unpairing Station 22 serves as a functional coupling substitute for the Belt Unit 11, which instead of attaching to the Belt Unit on the User 14, the Unpairing Station is essentially a typically stationary element that acts as a docking, secure storage, and alternatively a 'hibernation' station for the Key Unit 12. Preferably, the Unpairing Station serves to unpair any particular Key Unit and prepare it for immediate 're-pairing' with a different Belt Unit. Additionally, with the Unpairing Station, as utilized in the Item Loss Prevention System 10, the User has the ability to store the Key Unit in a nightly lock box, without being docked to Belt Unit. This allows the Key Unit to enter a Key Unit Sleep 430, which will be described as shown in FIG. 4, and essentially places the Key Unit in a very low power consumption mode for storage and off-shift non-use. In the next shift, the Key Unit can automatically bind or "pair" to a new Belt Unit after off-shift storage.

Additionally, when the Key Unit 12 is unpaired and should be properly coupled with the Unpairing Station 22 or a Belt Unit 11, it is preferred that the Key Unit will alarm on significant movement, as sensed by the Accelerometer 30, or after a short period of time. This alarm prevents the unpaired Key Unit 12 from being misplaced, lost or stolen, but allows adequate time and movement for the User to attach the Key Unit to the Unpairing Station or Belt Unit. Also preferably, such alarm is set to allow for inadvertent motion cause by the User by removing or attaching an adjacent Key Unit.

FIG. 2 details the interrelationship of particular component parts of the Belt Unit 11. Electrical power for the Belt Unit originates at a Belt Battery 101, which is preferably a single, conventional 'AAA' type of battery having a nominal voltage of 1.5V. Optionally, this battery voltage may me stepped down to a system supply voltage of 0.9V, or any conventional supply voltage, as desired. Most preferably, for the operation of the Belt Unit, a Belt Voltage Boost 103 is performed by a step-up switching regulator to a resultant system supply voltage of 2.7 V for use as a Belt System Power 105 by the Belt Unit, as shown in FIG. 2. As an alternative to the preferred 'AAA' battery, any type of conventional DC power source, including rechargeable and self-contained, could be employed for the battery, and so could be employed for the Belt Unit.

The Belt System Power 105 provides electrical power to the components of the Belt Unit 11, including a Belt Microcontroller and Radio Chip 115, a Belt Vibration Motor 121 and a Belt Piezo Beeper 122. Additionally the Belt System Power serves a Belt Radio 118 for communications external to the Belt Unit. The Belt Microcontroller and Radio Chip performs the required microprocessor logic functions of the Belt Unit, as detailed in FIG. 4 through 6, along with radio features for communicating with a Key Microcontroller and Radio Chip 215, in the Key Unit 12 through its Key Radio 218.

As shown in FIG. 2, the Belt Radio 118 preferably employs a conventional chip-based antenna, and most preferably a two-antenna system is employed with both transmitting and receiving at approximately a 2.4 GHz frequency, to achieve single radio amplitude-based antenna diversity, with a First Belt Chip Antenna 131 and a Second Belt Chip Antenna 132, coupled with a Belt RF Switch 134, serving to alternate the operation of the two chip antennas, and additionally preferably employing a Belt Balun 135 to balance the antennas and minimize interference. The Belt Balun functions to convert between a balanced 'radio frequency' (RF) signal and unbalanced RF signal. An "integrated balun" is preferably used in the Belt Microcontroller Radio System 15, primarily for space-savings. However, as an option, a Belt Balun made from discrete components could be used, as known by those skilled in RF circuit component design.

FIG. 3 details the interrelationship of particular component parts of the Key Unit 12. The electrical power for the Key Unit 12 originates at a Key Battery 201, which like the Belt Battery 101 is preferably a single, conventional 'AAA' type of battery, with a nominal voltage of 1.5V. Optionally, this battery voltage may me stepped down to a system supply voltage of 0.9V, or any conventional supply voltage, as desired. Most preferably, for the operation of the Key Unit, a Key Voltage Boost 203 is performed by a step-up switching regulator to a resultant system supply voltage of 2.7V for use as a Key System Power 205 205, as shown in FIG. 3. Again, as an alternative to the preferred 'AAA' battery, any type of conventional DC power source, including rechargeable and self-contained, could be employed for the battery and so could be employed for the Key Unit.

Similar to the Belt System Power 105, the Key System Power 205 provides electrical power to the components of the Key Unit 12, including the Key Microcontroller and Radio Chip 215, a Key LED 256, the Accelerometer 30, and a Key Piezo Beeper 265. Additionally, the Key System Power serves a Key Radio 218 for communications external to the Key Unit. The Key Microcontroller and Radio Chip 215 performs the required microprocessor logic functions of the Key Unit, as detailed in FIG. 4 through 6, along with radio features for communicating through a Key Radio Chip 218, to the Belt Unit 12 through its Belt Radio 118.

As shown in FIG. 3, the Key Radio 218 preferably also employs a conventional chip-based antenna, for transmitting and receiving at approximately the 2.4 GHz frequency, with a Key Chip Antenna 231. Additionally, the Key Radio preferably employs a Key Balun 235 to balance the antenna and minimize interference. Like the Belt Balun 135, the Key Balun functions to convert between a balanced RF signal and unbalanced RF signal. An "integrated balun" is preferably employed for the Key Microcontroller Radio System 20, primarily for space-savings. However, as an option, a Key Balun made from discrete components could be used, as known by those skilled in RF circuit component design.

Most preferably, both the Belt Microcontroller and Radio Chip 115 and the Key Microcontroller and Radio Chip 215 selected and employed is the CC2541 model of 'dual stack processors,' as manufactured by Texas Instruments, of Dallas Tex. The CC2541 is a power-optimized true 'system-on-chip,' expressly designed for both Bluetooth® low-energy and 2.4 GHz radio applications.

The Belt Radio 118 and Key Radio 218 preferably employ the Bluetooth brand of communication protocol. Bluetooth® is a proprietary and widely used industry standard wireless technology standard for exchanging data over short distances using short-wavelength UHF radio waves in the 'industrial, scientific and medical radio band' (ISM), which is the 2.4 GHz to 2.485 GHz frequency range, as utilized in fixed and mobile devices and 'building personal area networks' (PANs). The Bluetooth® communications protocol is desirable in that it can connect several devices, overcoming problems of synchronization. However, alternative antenna and communication protocols besides Bluetooth® are considered for use with the Belt Radio and Key Radio, as are known to those skilled in the field of small electronic device communications.

As discussed above, the Improved Item Loss Prevention System 10 employs the Belt Radio 118 within the Belt Unit, and the Key Radio 218 within the Key Unit 12, working together with an Accelerometer 30 as an 'electronic tether,' to keep the item 77 attached to the Remote Unit within an approximate fifteen foot radius away from the User 14, who wears the hosting Belt Unit on their person. The Belt Microcontroller and Radio System 15 communicates with the Key Microcontroller and Radio System 20 to share data and ascertain if an alarm to the User is required, as detailed in FIGS. 4 though 6. Most preferably, the Key Unit is easily removable from the Belt Unit, with the Key Unit nest-able within the Belt Unit and mate-able to a hinged Receiver Clip 80, as shown in FIG. 8. The Receiver Clip provides a 'single action release' between the Key Unit and the Belt Unit, and the Key Unit can be returned to the Belt Unit with a simple hook-and-lock action to attach back together, as shown in FIG. 7.

If the key or item 77 on the Key Unit 12 moves beyond the preferred ten to fifteen feet, or any other preset Separation Distance from the Belt Unit 11, both the Belt Unit and the Remote Unit immediately respond with unique alarms. The Belt Unit on the User 14 vibrates by action of the Belt Vibration Motor 121, and emits a chirp alert by action of the Belt Piezo Beeper 122. The Belt Vibration Motor is preferably a standard 3Volt DC 'rumble pack' style motor, and the Belt Piezo Beeper is preferably a differentially driven piezo-type of audible buzzer, with a tone and variable pulse generation capability. The Key Unit also sounds an alarm, preferably with a Key Piezo Beeper 265 that is also a piezo-type and most preferably of the same type as the Belt Piezo Beeper, but optionally louder to reach the remote User. Additionally the Key Unit includes the Key LED 256, which is preferably a conventional HB or 'high brightness' type of bright LED warning strobe.

Figure 5:
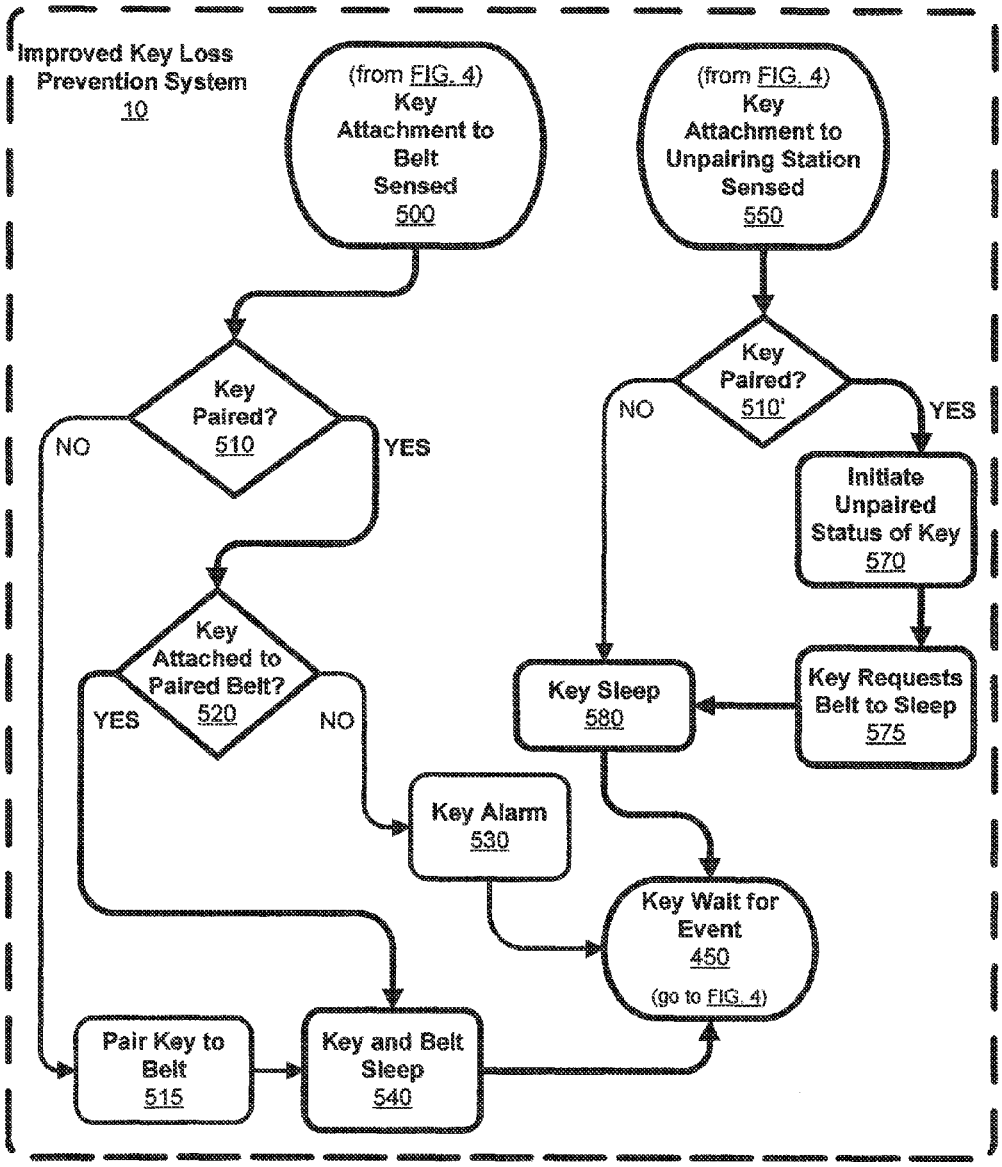
FIG. 5 is a first operational schematic diagram of a portion of an improved item loss prevention system, detailing features according to an embodiment of the invention.
Figure 6:
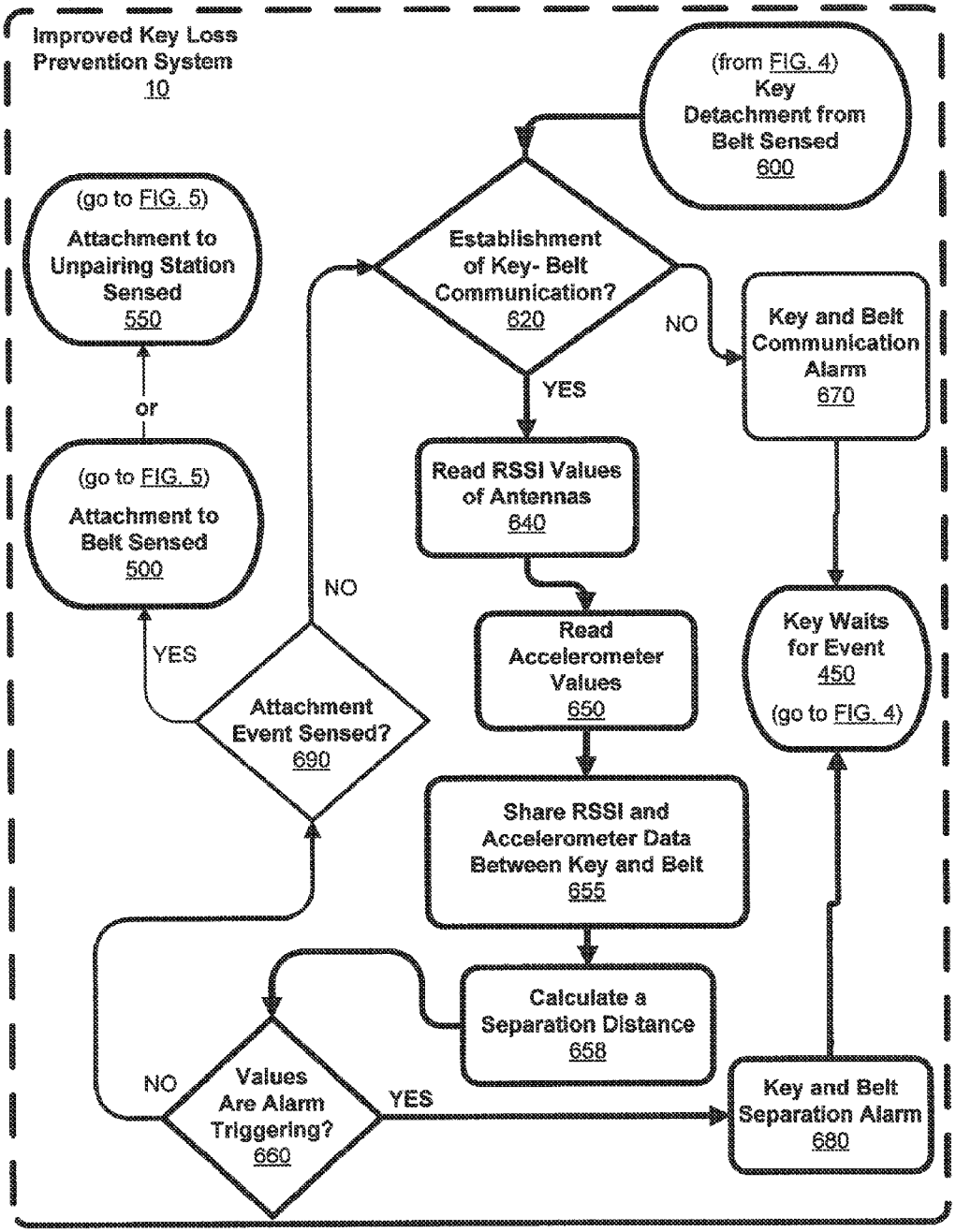
FIG. 6 is a second operational schematic diagram of a portion of an improved item loss prevention system, detailing features according to an embodiment of the invention.

The overall components of the Improved Item Loss Prevention System 10 are shown schematically in FIG. 1, with the detailed component parts of the Belt Unit 11 shown in FIG. 2, and the detailed component parts of the Key Unit 12 shown in FIG. 3. Again, FIGS. 4 through 6 show operational or process features of the Loss Prevention System, with FIG. 4 showing an overall process schematic diagram, and FIGS. 5 and 6 detailing operational portions of FIG. 4. Referring to FIG. 4, after the Key Unit Power On 45 is executed by the Item Loss Prevention System, as initiated by the User 14, the Key Unit Initialize 40 is performed, as executed by the Key Microcontroller and Radio Chip 215. The Key Unit Initialize includes typical pre-checks such as power stabilization of electro-mechanical components, and an initial check of the Bluetooth® status, for clear channels of radio communication for use by the Belt Unit 11 and the Key Unit 12. This communications linkage is as typically performed through digital "handshake" and authentication protocols, as known to those skilled in the field of electronic device interfacing, the Belt Unit and Key Unit communicate with each other and exclude communications with all other potentially interfering wireless communications systems utilizing the same frequencies. With unique identifications and authentication with each Key Unit Initialize 40 function, a multiple of Belt Units and their paired Key Units can operate properly in proximity to each other.

Continuing with the initial operational schematic of FIG. 4, a successful Key Unit Initialize 420 brings the Item Loss Prevention System 10 to the status of a Key Unit Ready 425, to which if no 'events' are occurring, places the Key Unit 12 into the Key Unit Sleep 430. This mode of low power consumption status is maintained while the Key Waits for Event 450.

To conserve battery power, when not in use, the Key Unit 12 of the Key Loss Prevention System 10 enters a mode of Key Unit Sleep 430. From this sleep mode, the Key Unit can immediately cycle into a Key Waits for Event 450. These specific 'events' can occur to awake the programming of the Key Unit as programmed into the Key Microcontroller and Radio Chip 215 for the execution of further actions. As shown in FIG. 4, three such 'events' include, a Key Attachment to Belt Unit Sensed 500, a Key Attachment to Unpairing Station Sensed 550, and a Key Detachment from Unpairing Station Sensed 600.

If the Key Attachment to Belt Unit Sensed 500 occurs, the logic of the Key Unit 12, again as programmed into the Key Microcontroller and Radio Chip 215, queries is the Key Paired? 510, as detailed in FIG. 5. If this query returns with a 'YES,' the query continues with a Key Attached to Paired Belt? 520. This query ascertains if the Key Unit is properly paired to the Belt Unit 11 it is presently attached to, or somehow attached to the wrong Belt Unit or an otherwise un-paired to Belt Unit. If this follow-up query returns with a 'YES,' the Key Unit and Belt Unit Sleep 540, which essentially means that the paired Key Unit and Belt Unit are properly paired and correctly mated.

However, if the query Key Paired? 510 returns with a 'NO,' the preferred programming continues to Pair Belt to Key 515, as shown in FIG. 5, to properly pair the Key Unit 12 with the Belt Unit 11. Again, the properly paired and correctly mated Key Unit and Belt Unit Sleep 540.

If the Key Attached to Paired Belt? 520 query returns with a 'NO,' the programming ascertains that the Key Unit 12 is improperly paired to the Belt Unit 11 it is presently attached to, or attached to the wrong Belt Unit or an otherwise un-paired to Belt Unit. This mis-attachment follows with a Key Alarm 530. The Key Alarm may be a variety of notifications, including audio, visual and vibratory notifications to the User 14. Preferably, a Key Piezo Beeper 222 and a Key LED 223, as shown in FIG. 3, are activated.

"Pairing" is a conventional term used herein to describe the uniquely established connection between two, mated electronic devices. Typically, the first device sends a code or 'passkey' that has been entered to the second device, and the passkeys are compared. If they are both the same, a trusted pair is formed, and the 'pairing' is established. Once the pairing has occurred, data can be exchanged between the devices. This pairing is remembered by the devices, which can connect to each without user intervention.

After either the Key and Belt Unit Sleep 540 or the Key Alarm 530 is entered, as discussed above, the Key Unit 12 immediately cycles back into the Key Waits for Event 450 of FIG. 4. Again, specific 'events' can occur to wake the programming of the Key Unit, and three such 'events' include, the Key Attachment to Belt Unit Sensed 500, the Key Attachment to Unpairing Station Sensed 550, and the Key Detachment from Unpairing Station Sensed 600.

Referring again to FIG. 4, if the Key Attachment to Unpairing Belt Unit Sensed 500 occurs, the logic of the Key Unit 12 as programmed into the Key Microcontroller and Radio Chip 215, queries is the Key Paired? 510', as detailed in FIG. 5. If this query returns with a 'YES,' the Key Unit should properly be unpaired from is Belt Unit 11, and so an Initiate Unpaired Status of Key 570 is executed. The Key Unit programming then places the Belt Unit into a battery conserving 'sleep mode,' with a Key Requests Belt to Sleep 575 command. The Key Unit then enters a Key Sleep 580, and then immediately cycles back into the Key Waits for Event 450, of FIG. 4.

As shown in FIG. 5, if instead the query of is the Key Paired? 510', returns with a 'NO,' the Key Unit 12 is confirmed to be properly unpaired and ready to dock with the Unpairing Station 22, and so the Key Unit enters the Key Sleep 580, and then immediately cycles back into the Key Waits for Event 450, of FIG. 4.

FIG. 6 details important operations and functions are executed by the Improved Key Loss Prevention System 10, relating to the functions performed after the Key Detachment from Belt Sensed 600 of FIG. 4. As shown in FIG. 6, a first critical follow-up query is if there is an Establishment of Key-Belt Communication 620. If this query returns with a 'YES,' the Key Loss Prevention System proceeds to monitor the location and movement of Key Unit 12 relative to the Belt Unit 11. A preferred first task in this monitoring is to Read RSSI Values of Antennas 640 for both units.

A "received signal strength indicator," commonly abbreviated as 'RSSI,' is a term typically used in electronic telecommunications to describe a measurement of the power present in a received radio signal. With the RSSI, a Separation Distance can be calculated between the Belt Unit 11 and the Key Unit 12. RSSI roughly correlates with distance, and preferably considers a relative antenna orientation, the two antennas of the Belt Radio 118 with the antenna diversity feature of the First Belt Chip Antenna 111 and the Second Belt Chip Antenna 112, so that different antenna orientations can be accounted for as a component part of the signal strength and more accurately determine the Separation Distance. Alternatively, a "time of arrival," sometimes referred to as "time of flight" could be calculated as an added tool to help calculate the Separation Distance, which is the travel time of the radio signal between the Key Unit 12 and the Belt Unit 11. By the relation between light speed and the carrier frequency of signal, the time of arrival could serve as a measure of the Separation Distance between the Key Unit and the Belt Unit. As a second task after the Establishment of Key-Belt Communication 620 query returns with a 'YES,' the Key Loss Prevention System 10 also proceeds to Read Accelerometer Values 650 of the Key Unit 12.

The Accelerometer 30 provides information in the form of data values, relating to movement of the Key Unit 12 that exceeds a set of pre-set threshold, which could include fast-moving shakes or slow-moving tilts, depending on its travel threshold values. Its motion detection function can analyze these acceleration changes, and detect the direction of the motion, to further determine if the detected movement is sufficient to initiate an alarm to the User 14. A preferred solid-state accelerometer for use in the Improved Key Loss Prevention System 10 is the Xtrinsic™ model MMA8652FC, of three-axis, 12-bit digital accelerometer, as manufactured by Freescale Semiconductor, Inc. of Austin, Tex., or an equivalent chipset.

As shown in FIG. 6, with the RSSI information and accelerometer values, the programming of the Loss Prevention System proceeds to Share RSSI and Accelerometer Data Between Key and Belt 655. This intercommunication between the Key Unit 12 and the Belt Unit 11 can occur by a variety of protocols or means, including infrared, radio and ultrasonic technologies, but again is preferably a Bluetooth® facilitated communication in the UHF band. With the raw Share RSSI and Accelerometer Data Between Key and Belt 655, the programming of the Key Loss Prevention System 10 and Calculate a Separation Distance 655, as discussed above. Again, this calculation is preferably based upon the RSSI data coupled with an adjustment for the orientation of the with the First Belt Chip Antenna 111 and the Second Belt Chip Antenna of the 112 Belt Radio 118, relative to the Key Chip Antenna 211 of the Key Radio 218.

After the Share RSSI and Accelerometer Data Between Key and Belt 655, the programming of the Key Loss Prevention System 10 can query if the Values Are Alarm Triggering 660. This is a critical analysis by the Key Loss Prevention System, in that if movement is detected by the Accelerometer 30 that exceeds the values expected for stationary or substantially un-moving Key Unit, coupled with the Calculate a Separation Distance 655 function employing the RSSI, the query result is "YES," and a Key and Belt Separation Alarm 680 is triggered. With the use of the Accelerometer 30, an additional level of verification is achieved to minimize false alarms and verify that an unwanted separation of the Key Unit from the Belt Unit has indeed occurred. Additionally, a shorter distance of separation between the Key Unit and the Belt Unit can be implemented, than is otherwise attainable with only the RSSI data. Instead of the approximate 15 meter typical separation distance achievable with RSSI information, approximately a 5 meter (or 15 foot) separation can be used to activate the alarms to the User 14. With this added verification and analysis, the Improved Key Loss Prevention System better serves the User in providing a reliable and accurate monitoring of the separated Key Unit.

Pertaining to the separation alarms of the Loss Prevention System 10 of FIG. 6, after either the Key and Belt Unit separation Alarm 680 or the Key and Belt Communication Alarm 670 are entered, the Key Unit 12 immediately cycles back into the Key Waits for Event 450 of FIG. 4. Again, specific 'events' occur to wake the programming of the Key Unit, including the Key Attachment to Belt Unit Sensed 500, the Key Attachment to Unpairing Station Sensed 550, and the Key Detachment from Unpairing Station Sensed 600.

Referring again to FIG. 6, if the query for the Establishment of Key-Belt Communication 620 returns with a 'NO,' the Key Loss Prevention System 10 proceeds as per the program instructions of the Key Microcontroller and Radio Chip 215, to trigger a Key and Belt Communication Alarm 670. The Key and Belt Communication Alarm serves to alert the User 14 that the Key Unit 12 and the Belt Unit 11 are not in communication and the needed system monitoring cannot proceed without troubleshooting the Key Loss Prevention System, which may mean that the Key Unit or the Belt Unit have been taken out of communication range relative to one another. After the Key and Belt Communication Alarm, the Key Unit immediately cycles back into the Key Waits for Event 450, of FIG. 4.

As also detailed in FIG. 6, if the important query after the Share RSSI and Accelerometer Data Between Key and Belt 655, of whether the Values Are Alarm Triggering 660, is determined to be "NO," the Key Loss Prevention System 10 then queries if an Attachment Event Sensed 690. After the alarm triggering movement is detected by the Accelerometer, coupled with the shared RSSI data and the alarm is sounded, the Key Loss Prevention System 10 proceeds to wait for an alarm terminating action. The Attachment Event Sensed is essentially a waiting function for either the Key Attachment to Belt Unit Sensed 500, or the Key Attachment to Unpairing Station Sensed 550 that acts to terminate the alarm, and both of which are shown in FIG. 4 and detailed in FIG. 5.

In the event of the Item Loss Prevention System 10 entering an alarm mode, there are three alarms that can engage. The Belt Unit 11 and the Key Unit 12 each emit a combination of unique alarms, including vibrations generated by the Belt Vibration Motor 121, audio signals generated by the Belt Piezo Beeper 122, the Key Piezo Beeper 265, and visual signals generated by the strobing of the Key LED 256. This combination of alarms makes identifying the location of the Key Unit and attached key or item 77 quick and fool-proof for the User 14. Preferably, an additional alarm is included in the Low Battery function. However, the preferred standard 'AAA' battery is expected to perform with an average life of six months for both the Belt Battery 101 and the Key Battery 201. Once either set of batteries reaches approximately 20% of usable charge, a warning light on the Belt Unit or the Key Unit can serve to alert the User 14.

The Improved Item Loss Prevention System 10 functions as an 'electronic tether' to keep the key or item 77, as attached to the Key Unit 12, within a five-step radius of the User 14, who wears the Belt Unit 11, preferably attached to the Belt 21 of the User. This radius can be verified with the use of the Accelerometer 30 to help ascertain the separation between the Bet Unit and the Key Unit, and prevent false alarms. If the item, such as the key ring 76, travels more than the preset five or so steps from the Belt Unit, both the Belt Unit and the Remote Unit immediately respond with unique alarms. The Belt Unit on the user also vibrates and preferably emits a 'chirping' alert while the Remote Unit sounds a loud alarm of up to 80 dB, and emits a bright LED warning strobe. The Key LED 256, as shown in FIG. 7 though 9 and schematically in FIG. 3, is preferably a is a 0.5 W, and bright white in color, and can be operated by a Key LED Driver and Voltage Boost 225, which can step-up the 2.7 V power from the Key System Power 205 to the needed 3.5 V. Alternatively, power to the Key LED Driver and Voltage Boost can be routed directly from the Key Battery 201, bypassing the Key Voltage Boost 203.

Most preferably, the Improved Item Loss Prevention System 10 is designed for industrial environments with durable and long-lasting usability. The vibration feature can be felt through heavy clothing or belts, and is unobtrusive in size and comfortable to wear. The Loss Prevention System proactively alerts the User 14 that they have been separated from their key or item 77, which can be a multiple of keys 79, as attached to a key-ring 76, and can be utilized in a wide variety of industries including; security, janitorial, property and facility management, hospitality, health care, and law enforcement or correction facilities.

Again, while the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

In compliance with the statutes, the invention has been described in language more or less specific as to structural features and process steps. While this invention is susceptible to embodiment in different forms, the specification illustrates preferred embodiments of the invention with the understanding that the present disclosure is to be considered an exemplification of the principles of the invention, and the disclosure is not intended to limit the invention to the particular embodiments described. Those with ordinary skill in the art will appreciate that other embodiments and variations of the invention are possible, which employ the same inventive concepts as described above, for instance in the application to crop drying and crop cooling systems and methods. Therefore, the invention is not to be limited except by the following claims, as appropriately interpreted in accordance with the 'doctrine of equivalents.'

The following is claimed:

1. An item loss prevention system comprising:

a host unit configured to receive a remote unit that is attachable to an item, and configured to be receivable onto a user; and a remote magnetic sensor on the remote unit and a host magnetic sensor on the host unit, the host magnetic sensor and the remote magnetic sensor configured to monitor, independently, a presence or an absence of the remote unit from a direct contact with the host unit;

an accelerometer in the remote unit, the accelerometer configured to detect a triggering movement of the remote unit; and the host magnetic sensor configured to initiate an alarm in the host magnetic unit in response to the host magnetic sensor detecting the absence of the remote unit, the remote magnetic sensor detecting the absence of the host unit, and the accelerometer detecting a triggering movement of the remote unit.

2. The item loss prevention system of claim 1, additionally including:

a received signal strength between a host antenna and a remote antenna, the host antenna included in the host unit and the remote antenna included in the remote unit, the received signal strength use with the accelerometer to determine if the item loss should enter into an alarm state.

3. The item loss prevention system of claim 1, wherein:

the host unit is digitally pairable to the remote unit, and the remote unit is configured to enter into an alarm mode in response to the accelerometer detecting motion without the remote unit being paired to a host unit.

4. The item loss prevention system of claim 3, additionally including:

an unpairing station configured to unpair the host unit from a remote unit, the unpairing station having a station magnetic sensor configured to monitor a presence or an absence of the remote unit from a direct contact with the unpairing station.

5. The item loss prevention system of claim 4, wherein the host unit magnetic sensor, the remote magnetic sensor, and the station magnetic sensor are Hall type sensors.

6. The item loss prevention system of claim 1, wherein the remote unit includes a key ring configured to receive a set of one or more keys.

7. The item loss prevention system of claim 1, wherein the host unit and the remote unit are configured to communicate with each other so that a multiple of pairs of the host units and the remote units can operate properly in proximity to each other.

8. The item loss prevention system of claim 1, wherein:

the host unit and the remote unit are configured to communicate wirelessly with one another, using a signal quality to judge a distance of separation, and the host unit is configured to notify the user with an alarm condition in response to a signal received from the remote unit by the host unit falling below a threshold of separation value, and the accelerometer detecting a triggering movement of the remote unit.

9. An item loss prevention system comprising:

a host unit configured to receive a remote unit that is attachable to an item, the host unit receivable onto a user; and a remote magnetic sensor on the remote unit and a host magnetic sensor on the host unit, the host magnetic sensor and the remote magnetic sensor configured to monitor, independently, a presence or an absence of the remote unit from a direct contact with the host unit;

an accelerometer in the remote unit, the accelerometer configured to detect a triggering movement of the remote unit;

the host magnetic sensor configured to initiate an alarm in the host magnetic unit in response to the host magnetic sensor detecting the absence of the remote unit, the remote magnetic sensor detecting the absence of the host unit, and the accelerometer detecting a triggering movement of the remote unit; and the host unit magnetic sensor and the remote magnetic sensor are Hall type sensors.

10. The item loss prevention system of claim 9, wherein the remote unit includes a key ring configured to receive a set of one or more keys.

11. The item loss prevention system of claim 9, wherein the host unit and the remote unit are configured to communicate with each other so that a multiple of pairs of the host units and the remote units can operate properly in proximity to each other.

12. The item loss prevention system of claim 9, wherein:

the host unit and the remote unit are configured to communicate wirelessly with one another, using a signal quality to judge a distance of separation, and the host unit is configured to notify the user with an alarm condition in response to a signal received from the remote unit by the host unit falling below a threshold of separation value and, the accelerometer detecting a triggering movement of the remote unit.

13. The item loss prevention system of claim 9, wherein:

the host unit is digitally pairable to the remote unit, and the remote unit is configured to enter into an alarm mode in response to the accelerometer detecting motion without the remote unit being paired to a host unit.

14. The item loss prevention system of claim 13, additionally including:

an unpairing station configured to unpair the host unit from a remote unit, the unpairing station having a station magnetic sensor configured to monitor a presence or an absence of the remote unit from a direct contact with the unpairing station.

15. The item loss prevention system of claim 14, wherein the host unit magnetic sensor and the station magnetic sensor are each a Hall type sensor.

* * * * *